US008168565B2

(12) United States Patent
Kitano

(10) Patent No.: US 8,168,565 B2
(45) **Date of Patent: *May 1, 2012**

(54) THERMAL RECORDING ADHESIVE LABEL

(75) Inventor: Tohru Kitano, Shizuoka-ken (JP)

(73) Assignee: Ricoh Company, Ltd., Tokyo (JP)

( * ) Notice: Subject to any disclaimer, the term of this patent is extended or adjusted under 35 U.S.C. 154(b) by 527 days.

This patent is subject to a terminal disclaimer.

(21) Appl. No.: 12/366,943

(22) Filed: Feb. 6, 2009

(65) Prior Publication Data

US 2009/0209419 A1 Aug. 20, 2009

(30) Foreign Application Priority Data

Feb. 14, 2008 (JP) ..... 2008-033259

(51) Int. Cl.
*B41M 5/30* (2006.01)
*B41M 5/40* (2006.01)

(52) U.S. Cl. ..... 503/226; 503/200

(58) Field of Classification Search ..... None
See application file for complete search history.

(56) References Cited

U.S. PATENT DOCUMENTS

2006/0068191 A1 3/2006 Goto et al.
2006/0159913 A1 7/2006 Kugo et al.
2008/0070035 A1 3/2008 Kitano et al.

FOREIGN PATENT DOCUMENTS

| | | |
|---|---|---|
| JP | 61-98581 | 5/1986 |
| JP | 8-100156 | 4/1996 |
| JP | 2002-275437 | 9/2002 |
| JP | 2004-279853 | 10/2004 |
| JP | 2005-81626 | 3/2005 |
| JP | 2006-143948 | 6/2006 |
| JP | 2007-76252 | 3/2007 |
| JP | 2007-204549 | 8/2007 |

OTHER PUBLICATIONS

Nov. 22, 2011 Japanese official action in connection with a counterpart Japanese patent application.

*Primary Examiner* — Bruce H Hess
(74) *Attorney, Agent, or Firm* — Cooper & Dunham LLP

(57) ABSTRACT

A thermal recording adhesive label, including a substrate; a thermal recording layer located overlying one side of the substrate, including a leuco dye and a color developer; a back coat layer located overlying the other side of the substrate; an adhesive layer located overlying the back coat layer; and a release paper located overlying the adhesive layer, wherein the thermal recording adhesive label further includes an adhesive undercoat layer comprising a thermoplastic resin and a filler between the back coat layer and the adhesive layer.

16 Claims, No Drawings

THERMAL RECORDING ADHESIVE LABEL

BACKGROUND OF THE INVENTION

1. Technical Field

This disclosure relates to a thermal recording adhesive label, and more particularly to a thermal recording adhesive label having sufficient adhesiveness with a little adhesive and no deterioration of colorability of its thermal recording layer after stored.

2. Discussion of the Related Art

Recently, a variety of recording materials are researched, developed and put into practical use with diversification and expanded needs of information. Among the recording materials, thermal recording materials have advantages of (1) being capable of simply recording images with only heating processes and (2) being capable of making apparatuses required compact because its mechanism is simple, and being easy to handle with and inexpensive. Therefore, the thermal recording materials are widely used in an information processing field such as output from desk calculators, computers, etc.; a recorder field such as medical measurements; low to high-speed facsimile fields; an automatic ticket vendor field such as railway tickets and entrance tickets; a thermal copying field; a label for POS system field; a tag field, etc.

The thermal recording adhesive label typically has a structure in which a substrate, a thermal recording layer, an adhesive layer and a release paper are layered. The release paper includes high-density base papers such as glassine papers, clay-coated papers, and polyethylene laminated papers coated with release agents such as silicone compounds and fluorine-containing compounds. Adhesives used is the adhesive layer include emulsion types such as rubbery, acrylic, vinylether adhesives; solvent types; hot melt adhesives, etc. Particularly, the acrylic emulsion type adhesives are widely used in terms of safety, quality and cost.

However, the emulsion type adhesives are likely to be inferior to solvent type adhesives in adhesiveness, cohesion and tackiness. Therefore, the emulsion type adhesives need to be coated more than the solvent type adhesives when preparing high-quality adhesive labels.

In addition, the thermal recording adhesive labels are typically required to have preservation stability of images recorded thereon. Therefore, methods of coating an aqueous emulsion of a resin having film formability and chemical resistance and methods of coating water-soluble polymeric compounds such as polyvinylalcohol are disclosed. The adhesive layer and release paper are formed on the back side of the substrate, and the above-mentioned rubbery and acrylic adhesives are typically used in the adhesive layer. Particularly, acrylic emulsion type adhesives are mostly used. Therefore, it is known that even before used as labels, low-molecular-weight oligomers, surfactants, etc. included in the adhesive layer enter the thermal recording layer, resulting in deterioration of the recording sensitivity thereof and occasional white spots of images in an extreme case.

Japanese published unexamined application No. 8-100156 discloses forming an undercoat layer (back coat layer) including a polypropylene resin or esteracrylate modified with an alkyleneimine compound as a main component on the back side of the substrate to solve this problem. However, this can prevent the adhesive from entering the thermal recording layer, but has insufficient adhesiveness unless not a little amount of the adhesive is used. Japanese published unexamined application No. 2006-143948 discloses a film including layered adhesives made from amorphous α-olefin copolymers. However, this has insufficient adhesiveness and does not work as an adhesive label. Further, Japanese published unexamined applications Nos. 2007-076252 and 2007-204549 disclose a thermal adhesive material in which an undercoat layer including a hollow filler is formed on a substrate and a thermal adhesive layer is formed thereon. However, this is a combination of the thermal adhesive layer which does not have adhesiveness before heated and the undercoat layer, and which is different from the constitution of the present invention. Further, the undercoat layer and the thermal adhesive layer are mixed with each other after heated, and which is different from the embodiment of the present invention. In addition, the undercoat layer reduces an energy for melting the thermal adhesive layer, and which is different from the effect of the present invention.

Japanese published unexamined applications Nos. 8-100156 and 2006-143948 disclose using a tackifier having a high softening point in an adhesive to prevent deterioration of the sensitivity of a thermal recording layer after stored for long periods. However, whether the tackifier prevents deterioration of the recording sensitivity depends on a (meth) acrylic acid ester monomer used in the adhesive.

Japanese published unexamined application No. 2004-279853 discloses a method of using a soap-free adhesive in thermal recording adhesive labels to prevent deterioration of the coloring sensitivity. This has an effect, but the recording sensitivity deteriorates under an environment of high temperature and high humidity when the (meth)acrylic acid ester monomer has an alkyl group having 4 or less carbon atoms.

Because of these reasons, a need exists for a thermal recording adhesive label having good coloring sensitivity after stored and sufficient adhesiveness with a little adhesive.

BRIEF SUMMARY

In an aspect of this disclosure, there is provided a thermal recording adhesive label having good coloring sensitivity after stored and sufficient adhesiveness with a little adhesive. In another aspect, there is provided a thermal recording adhesive label, comprising:

a substrate;

a thermal recording layer located overlying one side of the substrate, comprising a leuco dye and a color developer;

a back coat layer located overlying the other side of the substrate;

an adhesive layer located overlying the back coat layer; and a release paper located overlying the adhesive layer, wherein the thermal recording adhesive label further comprises an adhesive undercoat layer comprising a thermoplastic resin and a filler between the back coat layer and the adhesive layer.

DESCRIPTION OF THE PREFERRED EMBODIMENTS

Generally, the present invention provides a thermal recording adhesive label having good coloring sensitivity after stored and sufficient adhesiveness with a little adhesive.

More particularly, the present invention relates to a thermal recording adhesive label, comprising:

a substrate;

a thermal recording layer located overlying one side of the substrate, comprising a leuco dye and a color developer;

a back coat layer located overlying the other side of the substrate;

an adhesive layer located overlying the back coat layer; and a release paper located overlying the adhesive layer, wherein the thermal recording adhesive label further comprises an adhesive undercoat layer comprising a thermoplastic resin and a filler between the back coat layer and the adhesive layer.

The leuco dyes for use in the present invention are electron-releasing compounds, and can be used alone or in combination. They are colorless or light-colored dye precursors and conventional leuco dyes can be used without particular limitation. Triphenylmethanephthalide leuco compounds, triallylmethane leuco compounds, fluoran leuco compounds, phenothiazine leuco compounds, thiofluoran leuco compounds, xanthene leuco compounds, indophthalyl leuco compounds, spiropyran leuco compounds, azaphthalide leuco compounds, chromenopyrazole leuco compounds, methine leuco compounds, rhodamineanilinolactam leuco compounds, rhodaminelactam leuco compounds, quinazoline leuco compounds, diazaxanthene leuco compounds, bislactone leuco compounds, etc. are preferably used.

Specific examples of the leuco compounds include 6-[ethyl(4-methylphenyl)amino]-3-methyl-2-anilinofluoran, 2-anilino-3-methyl-6-diethylaminofluoran, 2-anilino-3-methyl-6-diethylaminofluoran, 2-anilino-3-methyl-6-(di-n-butylamino)fluoran, 2-anilino-3-methyl-6-(N-n-propyl-N-methylamino)fluoran, 2-anilino-3-methyl-6-(N-isopropyl-N-methylamino)fluoran, 2-anilino-3-methyl-6-(N-isobutyl-N-methylamino)fluoran, 2-anilino-3-methyl-6-(N-amyl-N-methylamino)fluoran, 2-anilino-3-methyl-6-(N-sec-butyl-N-ethylamino)fluoran, 2-anilino-3-methyl-6-(N-amyl-N-ethylamino)fluoran, 2-anilino-3-methyl-6-(N-isoamyl-N-ethylamino)fluoran, 2-anilino-3-methyl-6-(N-n-propyl-N-isopropylamino)fluoran, 2-anilino-3-methyl-6-(N-cyclohexyl-N-methylamino)fluoran, 2-anilino-3-methyl-6-(N-ethyl-p-toluidino)fluoran, 2-anilino-3-methyl-6-(N-methyl-p-toluidino)fluoran, 2-(m-trichloromethylanilino)-3-methyl-6-diethylaminofluoran, 2-(m-trifluoromethylanilino)-30-methyl-6-diethylaminofluoran, 2-(m-trichloromethylanilino)-3-methyl-6-(N-cyclohexyl-N-methylamino)fluoran, 2-(N-ethyl-p-toluidino)-3-methyl-6-(N-ethylanilio)fluoran, 2-(N-ethyl-p-toluidino)-3-ethyl-6-(N-propyl-p-toluidino)fluoran, 2-anilino-6-(N-n-hexyl-N-ethylamino)fluoran, 2-(o-chloroanilino)-6-diethylaminofluoran, 2-(o-chloroanilino)-6-dibutylaminofluoran, 2-(m-trifluoromethylanilino)-6-diethylaminofluoran, 2-(p-acetylanilino)-6-(N-n-amyl-N-n-butylamino)fluoran, 2-benzylamino-6-(N-ethyl-p-toluidino)fluoran, 2-benzylamino-6-(N-methyl-2,4-dimethylanilino)fluoran, 2-benzylamino-6-(N-ethyl-2,4-dimethylanilino)fluoran, 2-benzylamino-6-(N-methyl-p-toluidino)fluoran, 2-benzylamino-6-(N-ethyl-p-toluidino)fluoran, 2-(di-p-methylbenzylamino)-6-(N-ethyl-p-toluidino)-fluoran, 2-(α-phenylethylamino)-6-(N-ethyl-p-toluidino)fluoran, 2-methylamino-6-(N-methylanilino)fluoran, 2-methylamino-6-(N-ethylanilino)fluoran, 2-methylamino-6-(N-propylanilino)fluoran, 2-ethylamino-6-(N-methyl-p-toluidino)fluoran, 2-methylamino-6-(N-methyl-2,4-dimethylanilino)fluoran, 2-ethylamino-6-(N-ethyl-2,4-dimethylanilino)fluoran, 2-dimethylamino-6-(N-methylanilino)fluoran, 2-dimethylamino-6-(N-ethylanilino)fluoran, 2-diethylamino-6-(N-methyl-p-toluidino)fluoran, 2-diethylamino-6-(N-ethyl-p-toluidino)fluoran, 2-dipropylamino-6-(N-methylanilino)fluoran, 2-dipropylamino-6-(N-ethylanilino)fluoran, 2-amino-6-(N-methylanilino)fluoran, 2-amino-6-(N-ethylanilino)fluoran, 2-amino-6-(N-propylanilino)fluoran, 2-amino-6-(N-methyl-p-toluidino)fluoran, 2-amino-6-(N-ethyl-p-toluidino)fluoran, 2-amino-6-(N-propyl-p-toluidino)fluoran, 2-amino-6-(N-methyl-p-ethylanilino)fluoran, 2-amino-6-(N-ethyl-p-ethylanilino)fluoran, 2-amino-6-(N-propyl-p-ethylanilino)fluoran, 2-amino-6-(N-methyl-2,4-dimethylanilino)fluoran, 2-amino-6-(N-ethyl-2,4-dimethylanilino)fluoran, 2-amino-6-(N-propyl-2,4-dimethylanilino)fluoran, 2-amino-6-(N-methyl-p-chloroanilino)fluoran, 2-amino-6-(N-ethyl-p-chloroanilino)fluoran, 2-amino-6-(N-propyl-p-chloroanilino)fluoran, 1,2-benzo-6-(N-ethyl-N-isoamylamino)fluoran, 1,2-benzo-6-dibuylaminofluoran, 1,2-benzo-6-(N-methyl-N-cyclohexylamino)fluoran, 1,2-benzo-6-(N-ethyl-N-toluidino)fluoran, 2-anilino-3-methyl-6-(N-2-ethoxypropyl-N-ethylamino)fluoran, 2-(p-chloroanilino)-6-(N-n-octylamino)fluoran, 2-(p-chloroanilino)-6-(N-n-palmitylamino)fluoran, 2-(p-chloroanilino)-6-(di-n-octylamino)fluoran, 2-benzoylamino-6-(N-ethyl-p-toluidino)fluoran, 2-(o-methoxybenzoylamino)-6-(N-methyl-p-toluidino)fluoran, 2-dibenzylamino-4-methyl-6-diethylaminofluoran, 2-dibenzylamino-4-methoxy-6-(N-methyl-p-toluidino)fluoran, 2-dibenzylamino-4-methyl-6-(N-ethyl-p-toluidino)fluoran, 2-(α-phenylethylamino)-4-methyl-6-diethylaminofluoran, 2-(p-toluidino)-3-(t-butyl)-6-(N-methyl-p-toluidino)fluoran, 2-(o-methoxycarbonylanilino)-6-diethylaminofluoran, 2-acetylamino-6-(N-methyl-p-toluidino)fluoran, 4-methoxy-6-(N-ethyl-p-toluidino)fluoran, 2-ethoxyethylamino-3-chloro-6-dibutylaminofluoran, 2-dibenzylamino-4-chloro-6-(N-ethyl-p-toluidino)fluoran, 2-(α-phenylethylamino)-4-chloro-6-diethylaminofluoran, 2-(N-benzyl-p-trifluoromethylanilino)-4-chloro-6-diethylaminofluoran, 2-anilino-3-methyl-6-pyrrolidinofluoran, 2-anilino-3-chloro-6-pyrrolidinofluoran, 2-anilino-3-methyl-6-(N-ethyl-N-tetrahydrofurfurylamino)fluoran, 2-mezidino-4',5'-benzo-6-diethylaminofluoran, 2-(m-trifluoromethylanilino)-3-methyl-6-pyrrolidinofluoran, 2-(α-naphthylamino)-3,4-benzo-4'-bromo-6-(N-benzyl-N-cyclohexylamino)fluoran, 2-piperidino-6-diethylaminofluoran, 2-(N-n-propyl-p-trifluoromethylanilino)-6-morpholinofluoran, 2-(di-N-p-chlorophenyl-methylamino)-6-pyrrolidinofluoran, 2-(N-n-propyl-m-trifluoromethylanilino)-6-morpholinofluoran, 1,2-benzo-6-(N-ethyl-N-n-octylamino)fluoran, 1,2-benzo-6-diallylaminofluoran, 1,2-benzo-6-(N-ethoxyethyl-N-ethylamino)fluoran, benzoleucomethyleneblue, 2-[3,6-bis(diethylamino)]-6-(o-chloroanilino)xanthyl benzoic acid lactam, 2-[3,6-bis(diethylamino)]-9-(o-chloroanilino)xanthyl benzoic acid lactam, 3,3-bis(p-dimethylaminophenyl)phthalide, 3,3-bis(p-dimethylaminophenyl)-6-dimethylaminophthalide (or crystal violet lactone), 3,3-bis(p-dimethylaminophenyl)-6-chlorophthalide, 3,3-bis(p-dibutylaminophenyl)phthalide, 3-(2-methoxy-4-dimethylaminophenyl)-3-(2-hydroxy-4,5-dichlorophenyl)phthalide, 3-(2-hydroxy-4-dimethylaminophenyl)-3-(2-methoxy-5-chlorophenyl)phthalide, 3-(2-hydroxy-4-dimethoxyaminophenyl)-3-(2-methoxy-5-chlorophenyl)phthalide, 3-(2-hydroxy-4-dimethylaminophenyl)-3-(2-methoxy-5-nitrophenyl)phthalide, 3-(2-hydroxy-4-diethylaminophenyl)-3-(2-methoxy-5-methylphenyl)phthalide, 3-(2-methoxy-4-dimethylaminophenyl)-3-(2-hydroxy-4-chloro-5-methoxyphenyl)phthalide and 3,6-bis(dimethylamino)fluorenespiro(9,3')-6'-dimethylaminophthalide, 6'-chloro-8'-methoxybenzoindolino-spiropyran, 6'-bromo-2'-methoxybenzoindolino-spiropyran, etc.

In addition, as the color developers used in the present invention, various electron-accepting substances are used to develop color by reaction with the leuco dyes upon application of heat. Examples thereof include the following phenolic compounds, organic or inorganic acidic compounds, and esters or salts thereof. Specific examples thereof include gallic acid, salicylic acid, 3-isopropylsalicylic acid, 3-cyclohexylsalicylic acid, 3,5-di-tert-butylsalicylic acid, 3,5-di-α-methylbenzylsalicylic acid, 4,4'-isopropylidenediphenol, 1,1'-isopropylidenebis(2-chlorophenol), 4,4'-isopropylidenbis(2,6-dibromophenol), 4,4'-isopropylidenebis(2,6-dichlorophenol), 4,4'-isopropylidenebis(2-methylphenol), 4,4'-isopropylidenebis(2,6-dimethylphenol), 4,4-isopropylidenebis(2-tert-butylphenol), 4,4'-sec-butylidenediphenol, 4,4'-cyclohexylidenebisphenol, 4,4'-cyclohexylidenebis(2-methylphenol), 4-tert-butylphenol, 4-phenylphenol, 4-hydroxyphenoxide, α-naphthol, β-naphthol, 3,5-xylenol, thymol, methyl-4-hydroxybenzoate, 4-hydroxyacetophenone, novolac-type phenol resin, 2,2-thiobis(4,6-dichlorophenol), catechol, resorcin, hydroquinone, pyrogallol, phloroglycine, phloroglycine carboxylic acid, 4-tert-octylcatechol, 2,2'-methylenebis(4-chlorophenol), 2,2'-methylenebis(4-methyl-6-tert-butylphenol), 2,2'-dihydroxydiphenyl, ethyl p-hydroxybenzoate, propyl p-hydroxybenzoate, butyl p-hydroxybenzoate, benzyl p-hydroxybenzoate, p-chlorobenzyl p-hydroxybenzoate, o-chlorobenzyl p-hydroxybenzoate, p-methylbenzyl p-hydroxybenzoate, n-octyl p-hydroxybenzoate, benzoic acid, zinc salicylate, 1-hydroxy-2-naphthoic acid, 2-hydroxy-6-naphthoic acid, zinc 2-hydroxy-6-naphthoate, 4-hydroxydiphenylsulfone, 4-hydroxy-4'-chlorodiphenylsulfone, bis(4-hydroxyphenyl)sulfide, 2-hydroxy-p-toluic acid, zinc3,5-di-tert-butylsalicylate, tin 3,5-di-tert-butylsalicylate, tartaric acid, oxalic acid, maleic acid, citric acid, succinic acid, stearic acid, 4-hydroxy phthalic acid, boric acid, thiourea derivative, 4-hydroxythiophenol derivative, bis(4-hydroxyphenyl)acetic acid, bis(4-hydroxyphenyl)ethyl acetate, bis(4-hydroxyphenyl)n-propyl acetate, bis(4-hydroxyphenyl)n-butyl acetate, bis(4-hydroxyphenyl)phenyl acetate, bis(4-hydroxyphenyl)benzyl acetate, bis(4-hydroxyphenyl)phenethyl acetate, bis(3-methyl-4-hydroxyphenyl)acetic acid, bis(3-methyl-4-hydi-oxyphonyl)methyl acetate, bis(3-methyl-4-hydroxyphenyl)n-propyl acetate, 1,7-bis(4-hydroxyphenylthio)3,5-dioxaheptane, 1,5-bis(4-hydroxyphenylthio)-3-oxapentane, dimethyl 4-hydroxyphthalate, 4-hydroxy-4'-methoxydiphenylsulfone, 4-hydroxy-4'-ethoxydiphenylsulfone, 4-hydroxy-4'-isopropoxydiphenylsulfone, 4-hydroxy-4'-propoxydiphenylsulfone, 4-hydroxy-4'-butoxydiphenylsulfone, 4-hydi-oxy-4'-isopropoxydiphenylsulfone, 4-hydroxy-4'-sec-butoxydiphenylsulfone, 4-hydroxy-4'-tert-butoxydiphenylsulfone, 4-hydroxy-4'-benzyloxydiphenylsulfone, 4-hydroxy-4'-phenoxydiphenylsulfone, 4-hydroxy-4-(m-methylbenzyloxy)diphenylsulfone, 4-hydroxy-4'-(p-methylbenzyloxy)diphenylsulfone, 4-hydroxy-4'-(o-methylbenzyloxy)diphenylsulfone, 4-hydroxy-4'-(p-chlorobenzyloxy)diphenylsulfone, 4-hydroxy-4'-oxyallyldiphenylsulfone, 2,4'-dihydroxydiphenylsulfone, etc.

A coating amount of the thermal recording layer cannot categorically be decided because of depending on compositions thereof or applications of thermal recording materials therein, however, it is preferably from 1 to 30 g/m$^2$, and more preferably from 2 to 20 g/m$^2$.

In addition, supplemental additives conventionally used as the thermal recording materials, such as a water-soluble polymer, an aqueous resin emulsion, a filler, a heat-meltable material, a surfactant, etc. can be used together with the leuco dye and the color developer in the thermal recording (coloring) layer of the present invention when needed.

Specific examples of the filler include fine powder of organic materials such as calcium carbonate, silica, titanium oxide, aluminum hydroxide, clay, baked clay, magnesium silicate, magnesium carbonate, white carbon, zinc oxide, barium sulfonate, surface-treated calcium carbonate or silica; and organic materials such as urea-formalin resin, copolymers of styrene and methacrylic acid and polystyrene.

Specific examples of the heat-meltable material include aliphatic acids such as stearic acids and behenic acids; aliphatic acid amides such as stearic acid amides and palmitic acid amides; metal salts of aliphatic acids such as zinc stearate, aluminum stearate, calcium stearate, zinc palmitate and zinc behenate; m-terphenyl; triphenyl methane; p-benzyloxy benzyl benzoate; β-benzyloxynaphthalene; β-phenylnaphthoate; 1-hydroxy-2-phenylnaphthoate; 1-hydroxy-2-methylnaphthoate; diphenylcarbonate; glarecoal carbonate; dibenzylterephthalate; 1,4-dimethoxynaphthalene; 1,4-diethoxynaphthalene; 1,4-dibenziroxynaphthalene; 1,2-diphenoxyethane; 1,2-bis(3-methylphenoxy)ethane; 1,2-bis(4-methylphenoxy)ethane; 1,4-diphenoxy-2-butene; 1,2-bis(4-mthoxyphenylthio)ethane; dibenxoylmethane; 4-diphenylthiobutane; 1,4-diphenylthio-2-butene; 1,3-bis(2-vinyloxyethoxy)benzene; 1,4-bis(2-vinyloxyethoxy)benzene; p-(2-vinyloxyethoxy)biphenyl; p-allyloxybiphenyl; p-propargyloxybiphenyl; dibenzoyloxymethane; dibenxoyloxy propane; dibenzyldisulfide; 1,1-diphenylethanol; 1,1-diphenylpropanol; p-benzyloxybenzylalcohol; 1,3-phenoxy-2-propanol; N-octadecylcarbamoyl-p-methoxycarbonylbenzene-octadecylcarb amoylbenzene; 1,2-bis(4-methoxyphenoxy)propane; 1,5-bis(4-methoxyphenoxy)-3-oxapantane; dibenzyloxalate; bis(4-methylbenzyl)ester oxalate; bis(4-chlorobenzyl)ester oxalate; 4-acetotoludide and other heat-meltable organic compounds having a melting point of from 50 to 200° C.

In the present invention, an intermediate layer including a binder, a filler, a heat-meltable material, etc. may be formed between the substrate and the thermal recoding layer for the purpose of preventing the adhesive form entering the thermal recoding layer, and improving the coloring sensitivity and smoothness thereof and adhesiveness thereof to the substrate when needed.

The intermediate layer preferably has a weight of from 2 to 10 g/m$^2$ when dried, and more preferably from 2.5 to 7 g/m$^2$ including a hollow particle having a weight-average particle diameter of from 0.8 to 5 μm in an amount not less than 80% by weight when dried such that the resultant thermal recording adhesive label has high sensitivity when forming images.

The thermal recording adhesive label of the present invention essentially includes a back coat layer on the back side of the substrate. A coloring disincentive included in the pressure-sensitive adhesive layer enters the thermal recoding layer without the back coat layer after the thermal recording adhesive label is stored for a long time.

The back coat layer preferably has a weight of from 0.5 to 3.5 g/M$^2$, and more preferably from 1.0 to 3.4 g/m$^2$. When less than 0.5 g/M$^2$, the thermal recording adhesive label is likely to curl in an environment of low humidity. When greater than 3.5 g/M$^2$, the thermal recording adhesive label is likely to block when stored in the form of a roll.

Polyvinylalcohol resin may be a saponified vinylacetate prepared by known methods, and may include a monomer copolymerizable with vinyl ester. Specific examples of the monomer include olefins such as ethylene, propylene and isobutylene; unsaturated acids such as an acrylic acid, a methacrylic acid, a crotonic acid, a maleic acid, a maleic acid anhydride and an itaconic acid or their salts; nitrites such as acrylonitrile and methacrylonitrile; amides such as an acrylic amide and a methacrylic amide; and olefin sulfonic acids such as an ethylene sulfonic acid, an allyl sulfonic acid and a methaallyl sulfonic acid or their salts.

In addition, the back coat layer may include hardeners such as glyoxal, a boric acid, an alum, a polyamide resin, an epoxy resin and a dialdehyde starch to strengthen the barrier properties thereof.

The back coat layer coating liquid may include various auxiliary agents when needed unless they impair the effect of the present invention.

Specific examples of the auxiliary agents include waxes such as zinc stearate, calcium stearate, a polyethylene wax, a carnauba wax, a paraffin wax and an ester wax; dispersants such as dioctyl sodium sulfosuccinate, a sodium dodecylbenzenesulfonate salt, a sodium lauryl alcohol sulfate salt, an alginate and fatty acid metallic salts; UV absorbers such as benzophenones and benzotriazoles, inorganic pigments such as magnesium carbonate, calcite light calcium carbonates, aragonite light calcium carbonates, heavy calcium carbonates, aluminum hydroxide, titanium dioxide, silicon dioxide, barium sulfate, zinc sulfate, talc, kaolin, clay, fired kaolin, alkali-modified silica, particulate anhydrous silica and colloidal silica; and organic pigments such as a styrene-micro ball, a nylon powder, a polyethylene powder and urea-formalin resin filler.

The thermal recording adhesive label of the present invention may have an overcoat layer on the thermal recording layer, which prevents a coloring disincentive in the adhesive label typically stored and used in the shape of a roll from passing through the release paper and exerting a harmful influence upon the thermal recording layer.

The overcoat layer includes a polyvinylalcohol resin and a filler as main components.

The polyvinylalcohol resin may be a saponified vinylacetate prepared by known methods, and may include a monomer copolymerizable with vinyl ester. Specific examples of the monomer include olefins such as ethylene, propylene and isobutylene; unsaturated acids such as an acrylic acid, a methacrylic acid, a crotonic acid, a maleic acid, a maleic acid anhydride and an itaconic acid or their salts; nitrites such as acrylonitrile and methacrylonitrile; amides such as an acrylic amide and a methacrylic amide; and olefin sulfonic acids such as an ethylene sulfonic acid, an allyl sulfonic acid and a methaallyl sulfonic acid or their salts.

Specific examples of the filler include inorganic fillers such as phosphate fiber, potassium titanate, needle-like magnesium hydroxide, whisker, talc, mica, glass flake, calcium carbonate, calcium carbonate in the form of plates, aluminum hydroxide, aluminum hydroxide in the form of plates, silica, clay, kaolin, calcined clay, and hydrotalcite; and organic fillers such as crosslinked polystyrene resins, urea resins, silicone resin powder, crosslinked polymethylmethacrylate resins and melamine-formaldehyde resins.

The overcoat layer preferably includes a water resistant additive as well, such as glyoxal, a melamine-formaldehyde resin, a polyamide resin and a polyamide-epichlorohydrine resin to improve water resistance thereof.

Further, besides the above-mentioned resins and fillers, the overcoat layer may include supplemental additives as well such as a surfactant, a heat-meltable material, a lubricant and a pressure coloring inhibitor. Specific examples of the heat-meltable material include those included in the thermal recording layer.

The overcoat layer preferably has a weight of from 1.0 to 5.0 g/m$^2$. When less than 1.0 g/m$^2$, recorded images has poor retain ability against water and acidic materials included foods, and plasticizers and fats included inorganic polymeric materials used for wrappers. When greater than 5.0 g/m$^2$, the coloring sensitivity deteriorates.

The thermal recording adhesive label preferably has an adhesive layer including, as a main component, at least one of a member selected from the group consisting of natural rubber latexes which are graft-copolymerized vinyl monomers, acrylic resins obtained by emulsion-polymerizing a monomer including, as a main component, at least an alkyl (meth) acrylate ester having an alkyl group, acrylic acid ester-styrene copolymers, acrylic acid ester-methacrylic acid ester-styrene copolymers and ethylene-vinylacetate copolymers. The main component only includes the above-mentioned polymeric materials except for optional additives such as a penetrant, a filming auxiliary agent, a defoamant, an antirust agent, a thickener, a wetter, an antiseptic, an ultraviolet absorber, a light stabilizer, a pigment and an inorganic filler. In the present invention, (meth)acryl represents acryl or methacryl.

Specific examples of the alkyl(meth)acrylate ester include n-pentyl(meth)acrylate, n-hexyl(meth)acrylate; 2-ethylhexyl (meth)acrylate, n-octyl(meth)acrylate, n-decyl(meth)acrylate, n-dodecyl(meth)acrylate, etc. These can be used alone or in combination.

Besides the above-mentioned components, the adhesive layer may optionally include a radical polymerizable unsaturated monomer including a carboxyl group, or a radical polymerizable unsaturated monomer copolymerizable with each of the unsaturated monomer of the alkyl(meth)acrylate ester and the radical polymerizable unsaturated monomer including a carboxyl group.

Specific examples of the radical polymerizable unsaturated monomer including a carboxyl group include $\alpha,\beta$-unsaturated carboxylic acids such as a (meth) acrylic acid; $\alpha,\beta$-unsaturated dicarboxylic acids such as an itaconic acid, a maleic acid and a 2-methyleneglutaric acid. These can be used alone or in combination.

The adhesive layer preferably has a weight of from 5 to 20 g/m$^2$. When less than 5 g/m$^2$, the resultant adhesive label does not have sufficient adhesiveness. Particularly, the label does not adhere to rough surfaces such as those of corrugated boards. When greater than 20 g/m$^2$, the adhesiveness is saturated, resulting in economic inefficiency.

The thermoplastic resins included in the adhesive undercoat layer include those used in the adhesive layer of the present invention, such as a member selected from the group consisting of natural rubber latexes which are graft-copolymerized vinyl monomers, acrylic acid ester copolymers, methacrylic acid ester copolymers, acrylic acid ester-methacrylic acid ester copolymers, acrylic acid ester-styrene copolymers, acrylic acid ester-methacrylic acid ester-styrene copolymers and ethylene-vinylacetate copolymers.

Specific examples of the filler used in the adhesive undercoat layer include conventional inorganic or organic fillers having an average particle diameter of from 0.5 to 10 μm, such as powders of calcium carbonate, silica, titanium oxide, aluminum hydroxide, clay, baked clay, kaolin, magnesium silicate, magnesium carbonate, white carbon, zinc oxide, barium sulfonate, surface-treated calcium carbonate or silica; and organic materials such as urea-formalin resin, styrene/methacrylic acid copolymers and polystyrene. In consideration of reduction of the adhesive, a plastic spherical hollow particulate material (hollow filler) having a hollow rate not less than 50%, particularly from 70 to 98%, is preferably used. When less than 50%, the adhesive undercoat layer does not have a sufficient thickness, resulting in deterioration of adhesiveness. In addition, the hollow filler typically has a hollow rate not greater than 98%.

The plastic spherical hollow particulate material in the present invention represents a foamed hollow particulate material including air or other gases with an outer thermoplastic resin shell. The hollow rate is a ratio of the inner diameter to the outer diameter of the hollow particulate material, determined by the following formula:

Hollow Rate(%)=Inner Diameter of the Hollow Particulate Material/Outer Diameter thereof×100.

The plastic spherical hollow particulate material is preferably an acrylonitrile/methacrylonitrile copolymer, an acrylonitrile-vinylidenechloride-methylmethacrylate copolymer, an acrylonitrile-methacrylonitrile-isobonylmethacrylate copolymer.

The adhesive undercoat layer preferably includes the filler in an amount of from 2 to 100 parts by weight per 100 parts by weight of the thermoplastic resin. When less than 2 parts by weight, the adhesiveness of the adhesive undercoat layer deteriorates. When greater than 100 parts by weight, only the adhesive layer has adhesiveness although the adhesive undercoat layer has high cohesion.

The adhesive undercoat layer of the present invention preferably has a weight of from 1 to 10 g/m$^2$, and more preferably from 2 to 10 g/m$^2$ when dried. When less than 1 g/m$^2$, the adhesive undercoat layer doe not have sufficient adhesiveness. When greater than 10 g/m$^2$, the adhesiveness is saturated, resulting in economic inefficiency.

The release paper is a substrate typically formed of a base paper such as high-density papers like a glassine paper, clay-coated papers, craft papers or high-quality papers; and a sealed layer formed of natural or synthetic resins such as casein, dextrin, starch, carboxymethylcellulose, methylcellulose, ethylcellulose, hydroxyethylcellulose, polyvinylalcohol, styrene-butadiene copolymers, ethylene-vinylchloride-copolymers, methylmethacrylate-butadiene copolymers, ethylene-vinylacetate copolymers and (meth)acrylic acid ester copolymers, or with inorganic pigments such as kaolin, clay, calcium carbonate, fired clay (fired kaolin), titanium oxide and silica and organic pigments such as plastic pigments on the base paper. Alternatively, the release paper may be prepared by laminating a synthetic resin such as polyethylene on a craft paper or a high quality paper to prep a real aminated paper, coating a silicone resin or a fluorine-containing resin dissolved in a solvent or not on the laminated paper so as to have a weight of from 0.05 to 3 g/m$^2$ when dried, and forming a release agent layer thereon by heat hardening, or electron beam or UV hardening.

Apparatuses coating the release agent are not particularly limited, and e.g., bar coaters, direct gravure coaters, offset gravure coaters, air knife coaters, multistage roll coaters, etc, can be used. The form of the substrate to be subjected to the coating treatment is not particularly limited, and sheet-form or roll-form substrates can be used.

Apparatuses coating the adhesive layer and the adhesive undercoat layer include roll coaters, knife coaters, bar coaters, slot die coaters, curtain coaters, etc. The adhesive layer and the adhesive undercoat layer may be formed on the release agent face or on the back side of the substrate (the other side of a side the thermal recording layer is formed on). In the present invention, the curtain coaters are most suitably used to form the adhesive layer and the adhesive undercoat layer.

The present invention can provide an extremely practicable thermal recording adhesive label having good coloring sensitivity and preservability, and sufficient adhesiveness with a little adhesive for use in POS labels, tags, tickets, films for medical vide printers, etc.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

Preparation of Thermal Recording Layer Coating Liquid

A [A liquid] and a [B liquid] including the following compositions were dispersed by a sand mill such that each had an average diameter not grater than 2 μm to prepare a dye dispersion [A liquid] and a developer dispersion [B liquid].

[A Liquid]

| | |
|---|---|
| 3-dibutylamino-6-methyl-7-anilinofluoran | 10 |
| Aqueous solution of itaconic-acid-modified polyvinylalcohol (KL-318 from Kuraray Co., Ltd.) having a concentration of 10% | 10 |
| Water | 30 |

[B Liquid]

| | |
|---|---|
| 4-hydroxy-4'-isopropoxydiphenylsulfone | 30 |
| Di(p-methylbenzyl)oxalate | 10 |
| Aqueous solution of itaconic-acid-modified polyvinylalcohol (KL-318 from Kuraray Co., Ltd.) having a concentration of 10% | 10 |
| Silica | 15 |
| Water | 197 |

Next, the [A liquid] and the [B liquid] were stirred and mixed at the following ratio to prepare a thermal recording layer coating liquid [C liquid].

[C Liquid]

| | |
|---|---|
| Dye dispersion [A liquid] | 50 |
| Developer dispersion [B liquid] | 292 |

<Preparation of Overcoat Layer Coating Liquid>

The following compositions were dispersed by a sand mill for 24 hrs to prepare a [D liquid].

[D Liquid]

| | |
|---|---|
| Aluminum hydroxide HIGILITE H-43M having an average particle diameter of 0.6 μm from Showa Denko K.K. | 20 |
| Aqueous solution of itaconic-acid-modified polyvinylalcohol (KL-318 from Kuraray Co., Ltd.) having a concentration of 10% | 20 |
| Water | 60 |

Next, the following compositions were mixed and stirred to prepare an overcoat layer coating liquid [E liquid].

| | |
|---|---|
| [D liquid] | 75 |
| Aqueous solution of diacetone-modified polyvinylalcohol (KL-318 from Kuraray Co., Ltd.) having a concentration of 10% | 100 |

-continued

| | |
|---|---|
| Aqueous solution of N-aminopolyacrylamide (having a molecular weight of 10,000 and a hydrazide rate of 50%) having a concentration of 10% | 15 |
| Aqueous solution of ammonia having a concentration of 1% | 5 |
| Water | 90 |

<Preparation of Back Coat Layer Coating Liquid>

The following compositions were mixed and stirred to prepare a [F liquid].

[F Liquid]

| | |
|---|---|
| Aqueous solution of polyvinylalcohol having a concentration of 10% | 100 |
| Kaolin (Ultra White 90 from Engelhard Corp.) | 10 |
| Water | 90 |

Next, the [C liquid] and the [E liquid] were coated and dried on the surface of a substrate (high-quality paper having a thickness of 80 μm) such that a thermal recording layer and an overcoat layer had weights of 5.0 g/m$^2$ and 3.4 g/m$^2$, respectively. Further, the [F liquid] was coated and dried on the back side of the substrate such that a back coat layer had a weight of 1.5 g/m$^2$. Finally, the surface was calendered to have a smoothness of 2,000 sec when measured by Oken type instrument to prepare a thermal recording material.

<Preparation of Adhesive Undercoat Layer Coating Liquid>

The following compositions were mixed and stirred to prepare a [G liquid].

| | |
|---|---|
| Plastic spherical hollow particulate material A (acrylonitrile/methacrylonitrile copolymer) having a solid content of 33% by weight, an average particle diameter of 3.0 μm and a hollow ratio of 91% | 20 |
| Pressure-sensitive adhesive acrylic emulsion having a solid content of 60% by weight from TOYO INK MFG. CO., LTD. | 22 |
| Water | 75 |

Next, the [G liquid] was coated and dried on the back coat of the thermal recording material such that an adhesive undercoat layer had a weight of 3.0 g/m$^2$.

Next, a pressure-sensitive adhesive acrylic emulsion having a solid content of 60% by weight from TOYO INK MFG. CO., LTD. was coated and dried by a wire bar on a release paper LSW from Lintec Corp. such that the adhesive had a weight of 7 g/m$^2$ to prepare an adhesive-coated release paper. The adhesive-coated release paper was attached onto the adhesive undercoat layer of the thermal recording material, and left in a temperature-controlled room at 23° C. and 50% Rh for 48 hrs under a load of 10 kg/20 cm×30 cm to prepare a thermal recording adhesive label.

Example 2

The procedure for preparation of the thermal recording adhesive label in Example 1 was repeated except for replacing the [G liquid] with a [H liquid] having the following compositions.

| | |
|---|---|
| Plastic spherical hollow particulate material A (acrylonitrile/methacrylonitrile copolymer) having a solid content of 33% by weight, an average particle diameter of 3.0 μm and a hollow ratio of 91% | 3 |
| Pressure-sensitive adhesive acrylic emulsion having a solid content of 60% by weight from TOYO INK MFG. CO., LTD. | 82 |
| Water | 15 |

Example 3

The procedure for preparation of the thermal recording adhesive label in Example 1 was repeated except for replacing the [G liquid] with a [I liquid] having the following compositions.

| | |
|---|---|
| Plastic spherical hollow particulate material A (acrylonitrile/methacrylonitrile copolymer) having a solid content of 33% by weight, an average particle diameter of 3.0 μm and a hollow ratio of 91% | 6 |
| Pressure-sensitive adhesive acrylic emulsion having a solid content of 60% by weight from TOYO INK MFG. CO., LTD. | 84 |
| Water | 10 |

Example 4

The procedure for preparation of the thermal recording adhesive label in Example 1 was repeated except for replacing the [G liquid] with a [J liquid] having the following compositions.

| | |
|---|---|
| Plastic spherical hollow particulate material A (acrylonitrile/methacrylonitrile copolymer) having a solid content of 33% by weight, an average particle diameter of 3.0 μm and a hollow ratio of 91% | 22 |
| Pressure-sensitive adhesive acrylic emulsion having a solid content of 60% by weight from TOYO INK MFG. CO., LTD. | 15 |
| Water | 10 |

Example 5

The procedure for preparation of the thermal recording adhesive label in Example 1 was repeated except for replacing the [G liquid] with a [K liquid] having the following compositions.

| | |
|---|---|
| Plastic spherical hollow particulate material A (acrylonitrile/methacrylonitrile copolymer) having a solid content of 33% by weight, an average particle diameter of 3.0 μm and a hollow ratio of 91% | 22 |
| Pressure-sensitive adhesive acrylic emulsion having a solid content of 60% by weight from TOYO INK MFG. CO., LTD. | 12 |
| Water | 65 |

Example 6

The procedure for preparation of the thermal recording adhesive label in Example 1 was repeated except for replacing the [G liquid] with a [L liquid] having the following compositions.

| | |
|---|---|
| Plastic spherical hollow particulate material A (acrylonitrile/methacrylonitrile copolymer) having a solid content of 33% by weight, an average particle diameter of 3.0 μm and a hollow ratio of 91% | 23 |
| Pressure-sensitive adhesive acrylic emulsion having a solid content of 60% by weight from TOYO INK MFG. CO., LTD. | 10 |
| Water | 67 |

Example 7

The procedure for preparation of the thermal recording adhesive label in Example 1 was repeated except for replacing the [G liquid] with a [M liquid] having the following compositions.

| | |
|---|---|
| Plastic spherical hollow particulate material B (acrylonitrile/methacrylonitrile copolymer) having a solid content of 41% by weight, an average particle diameter of 3.2 μm and a hollow ratio of 70% | 16 |
| Pressure-sensitive adhesive acrylic emulsion having a solid content of 60% by weight from TOYO INK MFG. CO., LTD. | 22 |
| Water | 62 |

Example 8

The procedure for preparation of the thermal recording adhesive label in Example 1 was repeated except for replacing the [G liquid] with a [N liquid] having the following compositions.

| | |
|---|---|
| Plastic spherical hollow particulate material C (acrylonitrile/methacrylonitrile copolymer) having a solid content of 40% by weight, an average particle diameter of 1.5 μm and a hollow ratio of 50% | 17 |
| Pressure-sensitive adhesive acrylic emulsion having a solid content of 60% by weight from TOYO INK MFG. CO., LTD. | 22 |
| Water | 61 |

Example 9

The procedure for preparation of the thermal recording adhesive label in Example 1 was repeated except for replacing the [G liquid] with a [O liquid] having the following compositions.

| | |
|---|---|
| Kaolin (Ultra White 90 from Engelhard Corp.) | 17 |
| Pressure-sensitive adhesive acrylic emulsion having a solid content of 60% by weight from TOYO INK MFG. CO., LTD. | 28 |
| Water | 55 |

Example 10

The procedure for preparation of the thermal recording adhesive label in Example 1 was repeated except for replacing the [G liquid] with a [P liquid] having the following compositions.

| | |
|---|---|
| Calcium carbonate (TUNEX-E from SHIRAIHSI KOGYO KAISHA, LTD.) | 17 |
| Pressure-sensitive adhesive acrylic emulsion having a solid content of 60% by weight from TOYO INK MFG. CO., LTD. | 28 |
| Water | 55 |

Example 11

The procedure for preparation of the thermal recording adhesive label in Example 1 was repeated except for replacing the pressure-sensitive adhesive acrylic emulsion with a 2-ethylhexylacrylate/methylmethacrylate/styrene copolymer SE-4040 having a solid content of 55% by weight from SHOWA HIGHPOLYMER CO., LTD.

Example 12

The procedure for preparation of the thermal recording adhesive label in Example 1 was repeated except for replacing the pressure-sensitive adhesive acrylic emulsion with a vinylacetate/ethylene/acryl copolymer S-900 having a solid content of 55% by weight from Sumitomo Chemical Co., Ltd.

Comparative Example 1

The procedure for preparation of the thermal recording adhesive label in Example 1 was repeated except for not forming the adhesive undercoat layer.

Comparative Example 2

The procedure for preparation of the thermal recording adhesive label in Example 1 was repeated except for not including the filler in the adhesive undercoat layer.

Comparative Example 3

The procedure for preparation of the thermal recording adhesive label in Example 1 was repeated except for not forming the back coat layer.

Each of the thus prepared thermal recording adhesive labels in Examples and Comparative Examples was subjected to an adhesiveness test and dynamic colorability test after stored. The evaluation standards are shown in Table 1 and the results are shown in Table 2.

<Adhesiveness Test>

The label was cut into a rectangle having a size of 2.5 cm×10 cm, and which was attached to a SUS board and a corrugated board in a longitudinal direction thereof by a rubber roller at a pressure of 2 kg. Then, 30 min later, the label was released at a release angle of 180° and a release speed of 300 mm/min. The adhesiveness (AN) of the label while released was measured by a force gauge at an interval of 0.1 sec to read data and an average thereof was calculated. This was performed under normal environment of 23° C. and 50% Rh.

<Dynamic Colorability Test>

The label was printed by a thermal paper colorability tester equipped with a thermal head from Panasonic Electronic Devices Co., Ltd. from Okura Engineering Co., Ltd. at an applied electric power: 0.45 W/dot; a line cycle: 8 ms/line; and a pulse width of 0.8 ms. The printed image density was measured by Macbeth densitometer RD-914.

<Dynamic Colorability Test After Stored>

After the label was stored under an environment of 40° C. and 90% Rh for 1 week, it was subjected to the above-mentioned dynamic colorability test. A sensitivity reduction (SR) rate was calculated by the following formula:

Sensitivity Reduction Rate(%)=Density after stored under an environment of 40° C. and 90% Rh for 1 week/Initial density×100.

TABLE 1

| AN N/25 mm | | | | | |
|---|---|---|---|---|---|
| SUS Board | | Corrugated Board | | SR rate % | |
| 18 or more | ◎ | 12 or more | ◎ | 95 or more | ◎ |
| 15 to less than 18 | ○ | 9 to less than 12 | ○ | 90 to less than 95 | ○ |
| 12 to less than 15 | Δ | 6 to less than 9 | Δ | 85 to less than 90 | Δ |
| Less than 12 | X | Less than 6 | X | Less than 85 | X |

TABLE 2

| | AN N/25 mm | | | | | |
|---|---|---|---|---|---|---|
| | SUS Board | | Corrugated Board | | SR rate % | |
| Example 1 | 18.3 | ◎ | 14.1 | ◎ | 97.5 | ◎ |
| Example 2 | 15.6 | ○ | 6.5 | Δ | 96.7 | ◎ |
| Example 3 | 15.9 | ○ | 8.1 | Δ | 96.9 | ◎ |
| Example 4 | 17.2 | ○ | 14.4 | ◎ | 97.3 | ◎ |
| Example 5 | 16.0 | ○ | 13.6 | ◎ | 96.9 | ◎ |
| Example 6 | 16.6 | ○ | 10.7 | ○ | 97.2 | ◎ |
| Example 7 | 16.9 | ○ | 11.4 | ○ | 97.9 | ◎ |
| Example 8 | 17.6 | ○ | 11.0 | ○ | 98.0 | ◎ |
| Example 9 | 16.8 | ○ | 9.8 | ○ | 98.2 | ◎ |
| Example 10 | 15.8 | ○ | 7.9 | Δ | 98.0 | ◎ |
| Example 11 | 13.6 | Δ | 9.1 | ○ | 97.5 | ◎ |
| Example 12 | 14.5 | Δ | 7.8 | Δ | 97.1 | ◎ |
| Comparative Example 1 | 9.9 | X | 2.9 | X | 94.5 | ○ |
| Comparative Example 2 | 11.1 | X | 5.2 | X | 91.4 | ○ |
| Comparative Example 3 | 20.0 | ◎ | 13.4 | ◎ | 78.7 | X |

The results in Table 2 prove that the thermal recording adhesive labels prepared in Examples 1 to 12 have better coloring sensitivities than those prepared in Comparative Examples 1 to 3.

Additional modifications and variations of the present invention are possible in light of the above teachings. It is therefore to be understood that within the scope of the appended claims the invention may be practiced other than as specifically described herein.

This document claims priority and contains subject matter related to Japanese Patent Application No. 2008-033259, filed on Feb. 14, 2008, the entire contents of which are herein incorporated by reference.

What is claimed is:

1. A thermal recording adhesive label, comprising:

a substrate;

a thermal recording layer located overlying one side of the substrate, comprising a leuco dye and a color developer;

a back coat layer located overlying the other side of the substrate;

an adhesive layer located overlying the back coat layer; and a release paper located overlying the adhesive layer, wherein the thermal recording adhesive label further comprises an adhesive undercoat layer comprising a thermoplastic resin and a filler between the back coat layer and the adhesive layer.

2. The thermal recording adhesive label of claim 1, wherein the filler is a plastic spherical hollow particulate material.

3. The thermal recording adhesive label of claim 2, wherein the filler has a hollow rate of from 50 to 98%.

4. The thermal recording adhesive label of claim 1, wherein the adhesive undercoat layer comprises the filler in an amount of from 2 to 100 parts by weight per 100 parts by weight of the thermoplastic resin.

5. The thermal recording adhesive label of claim 1, wherein the thermoplastic resin is an acrylic acid copolymer.

6. The thermal recording adhesive label of claim 1, wherein the adhesive layer and the adhesive undercoat layer are formed by curtain coating methods.

7. The thermal recording adhesive label of claim 1, wherein the back coat layer is configured to shield the thermal recording layer from diffusion from the adhesive layer, to preserve a coloring sensitivity of the thermal recording adhesive label.

8. The thermal recording adhesive label of claim 1, wherein the thermal recording adhesive label having the back coat layer has a higher coloring sensitivity as measured based on a density of an image printed on the thermal recording adhesive label than that of a thermal recording adhesive label not having the back coat layer.

9. The thermal recording adhesive label of claim 1, wherein a reduction in the coloring sensitivity of the thermal recording adhesive label is 5% or less, as measured based on a reduction in density of an image printed on the thermal recording adhesive label, after being stored at conditions of 40° C. and 90% Rh for one week.

10. The thermal recording adhesive label of claim 1, wherein the adhesive undercoat layer has a weight in the range of 1 to 10 g/m$^2$.

11. The thermal recording adhesive label of claim 1, wherein the back coat layer has a weight in the range of 0.5 to 3.5 g/m$^2$.

12. A thermal recording adhesive label comprising:

a substrate;

a thermal recording layer located overlying one side of the substrate, comprising a leuco dye and a color developer;

a back coat layer located overlying the other side of the substrate;

an adhesive layer located overlying the back coat layer; and a release paper located overlying the adhesive layer, wherein the thermal recording adhesive label further comprises an adhesive undercoat layer comprising a thermoplastic resin and a filler between the back coat layer and the adhesive layer; and wherein the back coat layer includes hardeners to strengthen shielding properties of the back coat layer.

13. The thermal recording adhesive label of claim 12, wherein the hardeners comprise at least one of a boric acid, an epoxy resin and a dialdehyde starch.

14. A thermal recording adhesive medium, comprising:

a substrate;

a thermal recording layer located overlying one side of the substrate, comprising a leuco dye and a color developer;

a back coat layer located overlying the other side of the substrate;

an adhesive layer located overlying the back coat layer; and a release paper located overlying the adhesive layer, wherein the thermal recording adhesive medium further comprises an adhesive undercoat layer comprising a thermoplastic resin and a filler between the back coat layer and the adhesive layer, and wherein the back coat layer shields the thermal recording layer from diffusion from the adhesive layer, to preserve a coloring sensitivity of the thermal recording adhesive medium.

15. The thermal recording adhesive medium of claim 14, wherein the thermal recording adhesive medium having the back coat layer has a higher coloring sensitivity as measured based on a density of an image printed on the thermal recording adhesive medium than that of a thermal recording adhesive medium not having the back coat layer.

16. The thermal recording adhesive medium of claim 14, wherein a reduction in the coloring sensitivity of the thermal recording adhesive medium is 5% or less, as measured based on a reduction in density of an image printed on the thermal recording adhesive medium, after being stored at conditions of 40° C. and 90% Rh for one week.

* * * * *